US007739858B2

(12) United States Patent
Maaranen

(10) Patent No.: US 7,739,858 B2
(45) Date of Patent: Jun. 22, 2010

(54) METHOD FOR FORMING INDIVIDUAL LETTERS PROVIDED WITH ENVELOPES

(75) Inventor: Esko Maaranen, Helsinki (FI)

(73) Assignee: Mail Systems Oy, Helsinki (FI)

( * ) Notice: Subject to any disclaimer, the term of this patent is extended or adjusted under 35 U.S.C. 154(b) by 0 days.

(21) Appl. No.: 12/122,787

(22) Filed: May 19, 2008

(65) Prior Publication Data

US 2009/0282783 A1 Nov. 19, 2009

(51) Int. Cl.
*B65B 61/06* (2006.01)

(52) U.S. Cl. ..... 53/411; 53/429; 53/435; 53/460; 270/52.02

(58) Field of Classification Search ..... 53/55, 53/206, 411, 429, 460, 558, 569, 435, 452; 270/52.02, 58.06
See application file for complete search history.

(56) References Cited

U.S. PATENT DOCUMENTS

| | | | | |
|---|---|---|---|---|
| 3,902,655 | A * | 9/1975 | Huffman | 229/69 |
| 4,012,268 | A * | 3/1977 | Johnsen | 156/200 |
| 4,189,895 | A | 2/1980 | Volkert et al. | |
| 4,343,129 | A * | 8/1982 | Gunther et al. | 53/206 |
| 4,464,878 | A * | 8/1984 | Golicz et al. | 53/206 |
| 4,543,082 | A * | 9/1985 | Stenner | 493/216 |
| 4,600,141 | A * | 7/1986 | Bradley et al. | 229/92.7 |
| 4,787,192 | A * | 11/1988 | Gunther, Jr. | 53/56 |
| 4,900,391 | A | 2/1990 | Mandel et al. | |
| 5,398,867 | A * | 3/1995 | Murphy | 229/69 |
| 6,073,421 | A * | 6/2000 | Lee | 53/206 |
| 6,266,944 | B1 | 7/2001 | Consiglio | |
| 6,865,864 | B2 * | 3/2005 | Katz | 53/460 |
| 7,090,114 | B1 * | 8/2006 | Katz | 229/92.8 |
| 2003/0222127 | A1 | 12/2003 | Katz | |
| 2006/0136490 | A1 | 6/2006 | Aggarwal et al. | |

FOREIGN PATENT DOCUMENTS

| | | | |
|---|---|---|---|
| EP | 0 297 843 | A1 | 1/1989 |
| EP | 0 447 183 | A2 | 9/1991 |
| EP | 0 780 243 | | 6/1997 |
| EP | 1 693 185 | A2 | 8/2006 |
| WO | WO 2004/089646 | | 10/2004 |
| WO | 2007/012740 | A2 | 2/2007 |

* cited by examiner

*Primary Examiner*—Thanh K Truong
(74) *Attorney, Agent, or Firm*—Young & Thompson

(57) ABSTRACT

A method for forming individual letters provided with envelopes from printed same-size sheets, includes pre-printed envelope forms for forming the envelopes, and in the immediate vicinity of each envelope form one or more letter forms for forming a letter or letters and inserting them in the envelope. The envelope form is led as such to envelope formation; the letter forms are cut at least on one side into letters which are smaller than the letter forms; the letters are brought to contact with the envelope form; the envelope form is folded in two around the letters and glued at the side edges to form an open envelope; and the open flap of the envelope is glued and folded so that a sealed letter provided with an envelope is formed.

11 Claims, 2 Drawing Sheets

METHOD FOR FORMING INDIVIDUAL LETTERS PROVIDED WITH ENVELOPES

FIELD OF THE INVENTION

Figure 1:
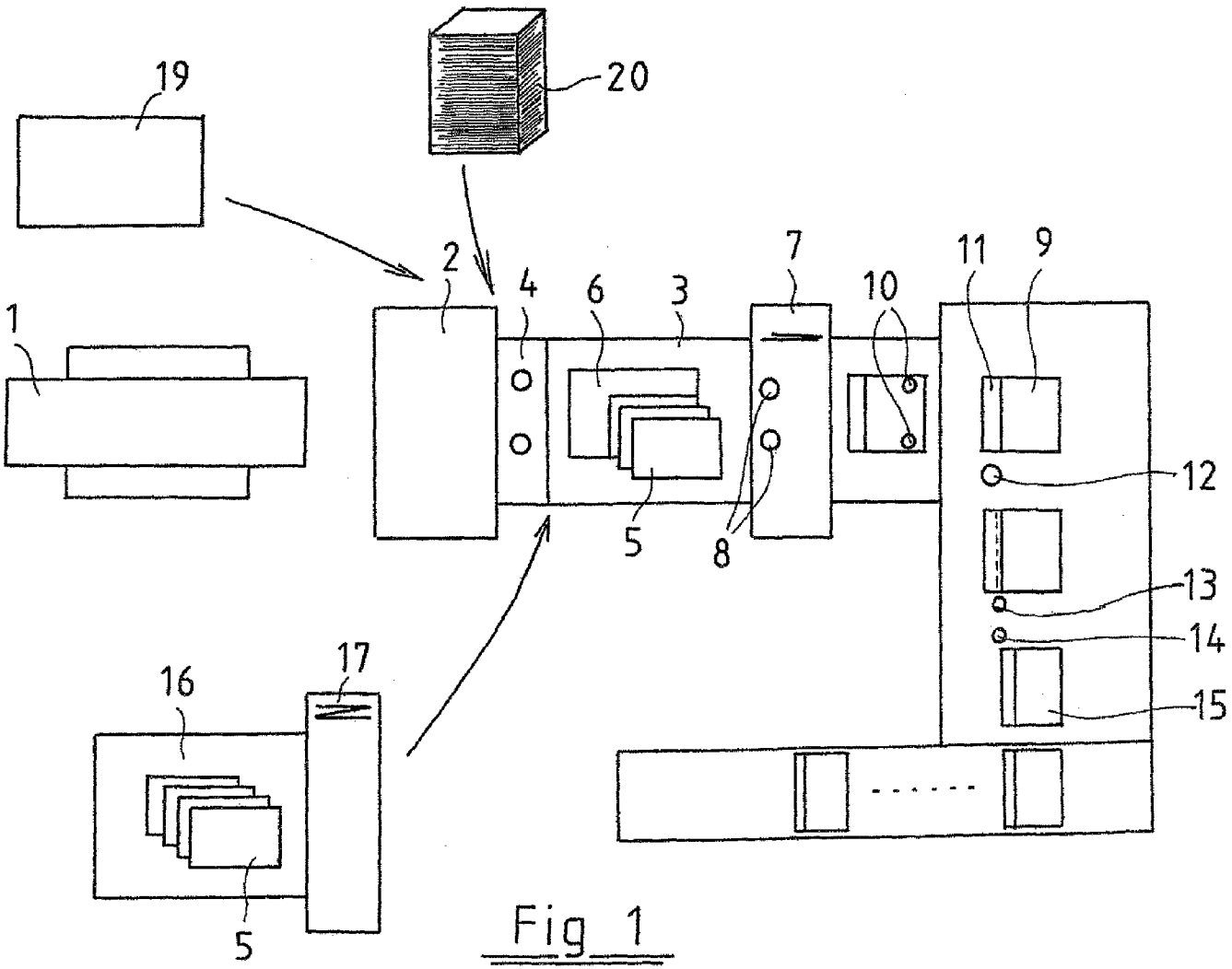

The invention relates to a method for forming individual letters provided with envelopes.

BACKGROUND OF THE INVENTION

The known technology in the field of the invention has been disclosed in publications EP 0297843, EP 0447183, U.S. Pat. No. 6,266,944, US 2004/0016210, US 2003/0222127 and EP 1693185.

The first three publications describe methods and apparatuses for producing sealed envelopes, wherein the envelope and the inserted letters are produced separately and from different source webs and then folded in a suitable manner and sealed mechanically inside the envelopes.

The fourth publication describes a method for cutting, folding and gluing identical envelopes from a paper web.

The fifth publication describes a method which is the closest to the invention, wherein an envelope form and the letters, coupons and the like to be inserted in the envelope are printed on the same paper web.

The problem with the publication representing the closest prior art is that a specific field has been assigned for the printouts in the paper web in such manner that the envelope form and the letter forms should cover at least half of that field. Consequently, in printing individual mail pieces which vary in size, the size of the field must be adapted to the space required by the largest possible mail piece. Therefore, in almost each mail piece, a considerable portion of the paper web must be cut off to be recycled, or if one wishes to avoid wasting paper, one can only produce one-size mail pieces which must also be so designed that the field assigned for a single printout becomes completely filled. However, such economy measures restrict the efficient use of the method to a considerable degree, so the average paper waste of 20-30% must only be accepted.

The sixth publication describes a method in which mail pieces of different sizes are made from the same paper web by cutting different-size envelopes of the web according to need. The greatest problems with this application are the complexity of the method, many oblique cuts in different directions and turns of the envelopes and the letters, many flaps and their gluing and folding, etc. This makes the entire method slow and susceptible to malfunctions and not suitable for efficient processing of large mass deliveries.

OBJECTIVE OF THE INVENTION

The objective of the invention is to eliminate the drawbacks referred to above. One specific objective of the invention is to disclose a new kind of method which allows completely individual letters which may vary freely in their number in a single envelope, allowing at the same time printing of the envelopes and the inserted letters either on the same continuous paper web of which they are cut and sorted in a suitable manner, or on equally sized sheets with a page printer. A further objective of the invention is to disclose a method in which the paper web or the sheets are cut as little as possible, the cuts being as quick and straight as possible, so that the entire process becomes as quick and reliable as possible. Similarly, one objective of the invention is to disclose a method in which the paper is utilized as efficiently as possible, so that the waste percentage of the paper is reduced to less than 10% and preferably less than 5%.

SUMMARY OF THE INVENTION

The method in accordance with the invention relates to forming individual letters provided with envelopes from a printed web comprising pre-printed envelope forms and letter forms, or from a set of same-size printed sheets in which a part comprises envelope forms and the other part letter forms. In the method, the envelopes are made from the envelope forms and the letter or letters which are inserted in the corresponding envelope are made from one or more letter forms positioned in the immediate vicinity of each envelope form. In accordance with the invention, the envelope forms of the pre-printed same-size sheets are led as such to envelope formation. The letter forms, on the other hand, are cut at least on one side into letters which are smaller than the letter forms and which are brought to contact with the envelope form corresponding to the letter. When all letters intended for the envelope are brought to contact with the envelope form, it is folded in two around the letters and glued on the side edges so that an open envelope including the appropriate letters is formed. Finally, the open flap of the envelope is glued and folded, so that a sealed mail piece provided with an envelope is formed.

In the method, it is possible to use a pre-printed web which is first cut into same-size rectangular envelope forms and letter forms, i.e. the entire web is cut into one-size sheets. Another alternative is to use a page printer for printing the envelope forms and the letter forms on the same-size rectangular sheets, the forms being then processed in accordance with the invention.

In one embodiment of the invention, the envelope form is first led to a holding stage, whereupon the letters are led one by one to the holding stage directly onto the envelope form. When all the letters for this mail piece have been placed onto the envelope form, it is folded together with the letters in two to form an envelope including the folded letters.

Another embodiment of the invention comprises leading the letters to an intermediate stage where the letters for the same envelope are stacked, whereupon they are folded and led folded onto the envelope form. In this manner it is possible that the letters, one or more, are folded in two, three or even more, always according to need.

In one embodiment of the invention, the envelope forms and the letter forms are printed successively on a paper web which is substantially equally wide as the envelope form so that the envelope form comes first in the processing, i.e. web cutting, order, followed by the corresponding letter forms. In this manner, it is easy to first lead the envelope form to the suitable holding stage, followed by the letter forms cut of the web onto or under the envelope forms after having been cut into letters.

However, the order may also be opposite, in which case the envelope forms and the letter forms are printed successively on a paper web which is substantially equally wide as the envelope form, the letter forms first and the corresponding envelope form last. In this case, the envelope form cut last of the web is brought to contact with the awaiting letters, either under or onto them, whereupon they can be folded to form the sealed envelope.

In the method in accordance with the invention, it is also possible to use a paper web which is at least twice as wide as the envelope form and on which the envelope forms and the letter forms are printed in rows successively, the envelope form first followed by the corresponding letter forms on the same or the following rows. Correspondingly, the letter forms can be printed first also with this wider web, followed last by the corresponding envelope form.

Preferably, all cuts of the web and the letter forms are realized in the invention by only cutting in the parallel or perpendicular direction to the movement of the web and the letter forms. In other words, the web is cut using only straight cross-cuts, and the sheets, whether provided from the web or from the page printer, are narrowed or shortened using only straight cuts in parallel to the straight edges. In this manner, the cutting blades do not have to be turned in different angles in the separate cutting steps; instead the cutting blades can either be constantly in the cutting position, or they can be, at the most, raised and lowered relative to the path along which the processed paper passes. In this manner, a further cutting of the web and the cut sheets does not slow down the process in any way or add stages that are susceptible to malfunctions to the process.

The method in accordance with the invention can be controlled in many ways. In producing same-size mail pieces, i.e. when each envelope includes the same number of letters, the process control is easy, because for example the first envelope form is always followed by the same number of letters, for example three.

If the number of letters varies in successive envelopes, the process control must be continuous. The envelope forms and the letter forms can be coded by many different visible or invisible methods known per se. The coding can also be realized in the system in the electrical form. However, it is preferred that an optical identifier or other remotely scanned identifier, such as a bar code or the like, is printed in conjunction with the printing of the web or the sheets at least on one of the letter forms and the envelope forms of the same mail piece, so that they can be processed based on the identifier.

However, the optically scanned identifiers are most preferably printed on all envelope forms and letter forms so that they can be processed based on the identifiers to form a sealed mail piece provided with an envelope. In this manner, each sheet cut of the web or printed separately comprises the individual information of whether it is an envelope form or a letter form, whether it should be cut on some of the sides, where it shall be led and in what manner it shall be folded.

The method in accordance with the invention provides considerable advantages compared to the prior art. The invention allows printing of envelopes and letters on the same paper web or on one large printed stack of sheets, and their mechanical processing into finished and sealed letters. The invention provides individual mail pieces in which the number of letters in the envelopes may vary freely. Furthermore, the invention provides, in the production of the mail pieces, fast and simple processes which enable the quick and efficient realization of large and yet individual mass deliveries. Moreover, the invention provides an automatic mailing system in which the paper webs or the sheets of paper can be used efficiently and without large losses.

LIST OF FIGURES

Figure 2:
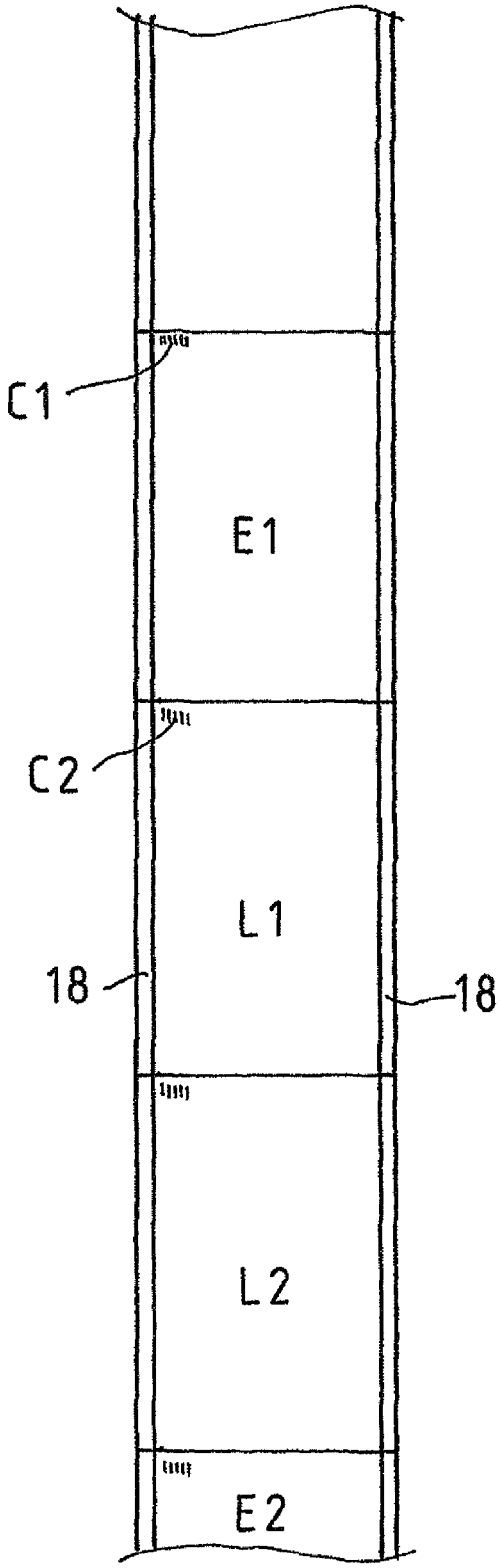
Figure 3:
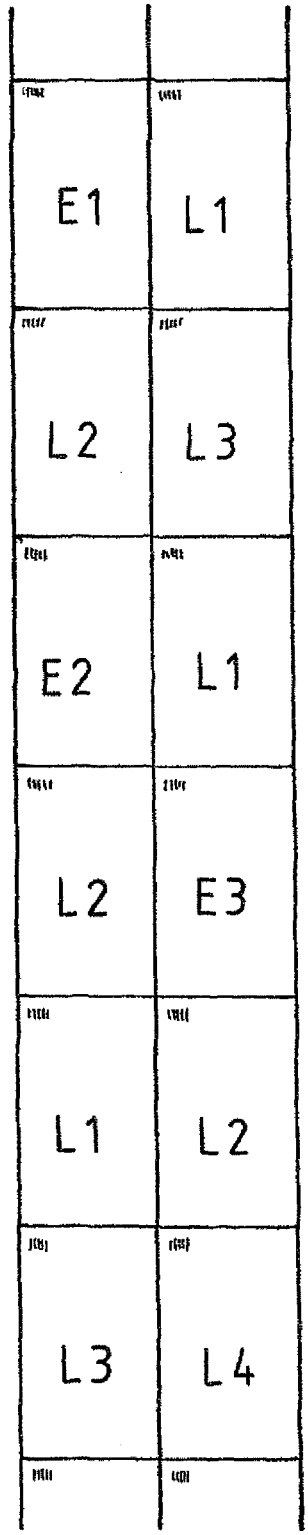

In the following section, the invention will be described in detail with reference to the accompanying drawings, in which FIG. 1 schematically represents a system which operates by the method in accordance with the invention, FIG. 2 schematically represents one printed paper web used in the method in accordance with the invention and FIG. 3 represents another embodiment of the printed paper web.

DETAILED DESCRIPTION OF THE INVENTION

FIG. 1 schematically represents one embodiment of the method in accordance with the invention. First, envelope forms E1, E2, E3, . . . and letter forms L1, L2, L3, . . . , which are to be formed into sealed mail pieces, are printed on a paper web 1. The method of printing the envelope forms and the letter forms on the paper web may vary, and the alternatives have been described in more detail in FIGS. 2 and 3.

In the printed paper web 1, the envelope form may come first, followed by the letter forms which are made into letters and inserted in the envelope formed of the envelope form. First, the envelope form 6 is cut with a cutter 2 of the paper web acquired from the unwound web reel and is led to a holding stage 3. It is also possible that the paper web used is wider, i.e. comprising two printed forms side by side. In this case, the cutter 2 preferably cuts the web first in two in the longitudinal direction, and the forms are then cut of the acquired two webs and led forward in the process successively in a suitable manner.

The system identifies the envelope form from an optically scanned code printed on it. Next, one or more letter forms for the envelope form waiting in the holding stage 3 have been printed on the web, the letter forms being also identified by the system from the codes printed on them. The letter forms are cut of the web by the cutter 2 to be suitably of the same size with the envelope forms. The letter forms are then led through a suitable cross-cutter (not shown in the figure) and a slitter 4 which narrows the letter forms into letters 5 which are narrower than the envelope form and which are then led one above the other to the holding stage 3 onto the envelope form 6.

Next, the envelope form 6 together with the letters 5 on top of it are led to a folding machine 7 which also accommodates glue spreaders 8 for spreading suitable glue on the longitudinal edges of the envelope form 6. In this manner, the envelope form folded in two is glued at the edges in the folding machine 7 to form an open envelope 9 including the letters folded with it. The glued edges of the letter are then pressed tight with pressure rollers 10.

Due to the fact that the envelope form 6 is initially longer than the letters 5, a closing flap 11 is formed in the open envelope 9, the flap being then die-cut 12, glued 13 and finally folded 14 such that a sealed envelope 15 including the letters 5 which are folded in two is provided.

The method described above also allows production of envelopes in which the letters are folded in three inside the envelope. In this case, an intermediate stage 16 followed by another folding machine 17 is positioned between the slitter 4 and the holding stage 3. In this manner, the envelope form 6 is led as usual directly from the cutter 2 to the holding stage 3, but the letters 5 for the same mail piece which have been pre-cut in width are first collected one above the other in the intermediate stage 16, whereupon they are folded in three in a stack with the other folding machine 17 and are only then led to the holding stage 3 onto the envelope form 6. When the letters are folded in three, it is possible to use same-size envelope forms and letter forms, in which case the letter forms only need to be narrowed slightly in order to fit folded in the envelope formed by the envelope form. When it is necessary to shorten the letter forms, it is possible to use a suitable cutter, not shown in the figure, instead of the intermediate stage 16 and the folding machine 17.

If a page printer is used instead of the printed web 1 in the embodiment of FIG. 1 for printing the envelope forms and the letter forms in the suitable order on same-size sheets, the crosswise web cutter 2 is naturally not necessary; instead the letter forms from the sheets can be led directly to the next required cutters and the envelope forms can be led in accordance with the invention to the holding stage suitable as such or they can be brought to contact with the folding machine. In this case, the page printer 19 can be directly connected to the start of the cutting or processing line, or stacks 20 of sheets can be printed with the page printer and then moved in a suitable manner to the starting point of the processing line.

FIG. 2 represents one way of printing the envelope forms and the letter forms on the paper web. The web comprises a bar code C1 which is used by the system for identifying the corresponding envelope form E1 and at the same time the position of the envelope form so that it can be cut of the web at the right position. This is followed by the bar code C2 which is used for identifying the first letter form L1 for the envelope form E1. And further, the next code is used for identifying the following letter form L2 for the same envelope. In this manner, each form is provided with a code for identifying it, and the system is able to cut it of the web at the suitable position and direct it to the right site to be processed further according to need. Moreover, drawn in FIG. 2 as a further embodiment are draw strips 18 for the web for moving the web in a manner known per se, with the possibility that the draw strips can be cut off at a suitable stage of the process. Without the draw strips, the envelope form is ready just by a straight cross-cut of the web, while the letter form must be narrowed, shortened or both, depending on the way the letters are intended to be folded inside the envelope.

The ready-printed forms presented in FIGS. 2 and 3 do not show this printed information, which may be any text or image material sent to the customer. However, the crosswise cutting lines of the webs, which are used for cutting the webs into separate envelope forms and letter forms and which are not actually visible, have been added to the figures for illustrative purposes.

FIG. 3 presents a printed web structure in which the envelope forms E1, E2, E3, E4, . . . and the corresponding letter forms L1, L2, L3, L4, . . . have been printed on a web which is twice as wide as the envelope form, i.e. two forms positioned side by side. In this embodiment, all forms have been coded, and therefore each form is identified separately based on its code and processed, such as cut in the longitudinal and cross-direction, stacked and folded, according to the instructions of the code. Furthermore, each form, when cut of the web, is equally long in the longitudinal direction of the web. Normally, the web is cut such that it is first divided in the longitudinal direction into two separate webs which are then passed substantially at the same time and one upon the other, and led alternately to common further processing.

Consequently, the envelope form E1 cut of the web is in this embodiment first led as such to the holding stage, and the following letter forms L1, L2 and L3 are led onto or under it, depending on the embodiment, the letter forms being cut, however, at least at one straight side to be smaller than initially before bringing them to contact with the envelope form. Correspondingly, the letter forms L1 and L2 following the envelope form E2 are brought to contact with it, and further the letter forms L1, L2, L3 and L4 to contact with the envelope form E3, etc. In this manner, the process advances one envelope at a time, using straight cuts only in the longitudinal direction of the paths of the paper or perpendicularly to it as scarcely as possible, without any oblique or curving cuts whatsoever.

The invention is not limited merely to the examples referred to above; instead many variations are possible within the scope of the inventive idea defined by the claims.

The invention claimed is:

1. A method for printing, forming, and sealing envelopes and their respective letters, the method comprising:

printing envelope forms and letter forms in rows on a paper web which is at least twice as wide as the envelope forms, a respective one of the envelope forms and one or more of the letter forms that is/are to be paired with the respective envelope form in a same mail piece being grouped together on the printed paper web, wherein the printing step includes printing an optical identifier on at least one of the letter forms and on the envelope form for a same mail piece, the envelope and letter forms being processed based on the optical identifier;

first cutting the printed letter forms and the printed envelope forms from the web, only by cutting in a direction which is parallel or perpendicular to movement of the web, the cut letter and envelope forms having the same length and width and being rectangular in shape;

moving the cut envelope forms to a holding stage;

second cutting the printed and previously cut letter forms at least on one side, only by cutting in a direction which is parallel or perpendicular to the movement of the letter forms, to form letters that are smaller than the letter forms;

pairing one or more of the letters with a respective envelope form by placing the letters onto the respective envelope form on the holding stage;

folding the envelope form around the one or more paired letters;

gluing side edges of the envelope form together to form an envelope with an open flap; and folding and gluing the open flap of the envelope so that a sealed letter containing the one or more paired letters is created.

2. The method of claim 1, wherein, in the printing step, in each group of a respective envelope form and one or more letter forms the respective envelope form precedes the letter forms in the direction of movement of the web, followed immediately in the same or the following rows by the one or more letter forms that is/are to be paired with the respective envelope form in a same mail piece.

3. The method of claim 2, wherein the respective letter forms are in the rows immediately following the respective envelope form.

4. The method of claim 1, wherein, in the printing step, in each group of a respective envelope form and one or more letter forms the one or more letter forms that is/are to be paired with the respective envelope form in a same mail piece precede the respective envelope form in the direction of movement of the web, followed immediately in the same or a following row by the respective envelope form.

5. The method of claim 4, wherein the respective envelope form is in the row immediately following the respective letter forms.

6. The method of claim 1, wherein, in the printing step, each group includes a respective envelope form and plural letter forms that are to be paired with the respective envelope form, and in the pairing step, the respective plural letters are paired with the respective envelope form.

7. The method of claim 6, wherein after the second cutting step, the letters are led to an intermediate stage where respective plural letters for the same mail piece are stacked, whereupon the stacked plural letters are folded and, in the pairing step, are led folded onto the respective envelope form.

8. The method of claim 6, wherein the letters are folded in three before leading them onto the envelope form.

9. The method of claim 1, wherein, in the folding step, the one or more paired letters are also folded.

10. The method of claim 1, wherein the paper web is no more than twice as wide as the envelope forms.

11. The method of claim 1, wherein the optical identifier is printed on all envelope forms and letter forms.

* * * * *